US009578931B2

(12) United States Patent
Osterberg et al.

(10) Patent No.: US 9,578,931 B2
(45) Date of Patent: Feb. 28, 2017

(54) BUCKLE ARRANGEMENT

(71) Applicant: SKYLOTEC GmbH, Neuwied (DE)

(72) Inventors: Martin Osterberg, Neuwied (DE); Peter Fust, Dierdorf (DE)

(73) Assignee: SKYLOTEC GMBH, Neuwied (DE)

( * ) Notice: Subject to any disclaimer, the term of this patent is extended or adjusted under 35 U.S.C. 154(b) by 0 days.

(21) Appl. No.: 14/968,154

(22) Filed: Dec. 14, 2015

(65) Prior Publication Data

US 2016/0166016 A1 Jun. 16, 2016

(30) Foreign Application Priority Data

Dec. 15, 2014 (DE) ..... 10 2014 118 679
Dec. 19, 2014 (DE) ..... 10 2014 119 219

(51) Int. Cl.
*A44B 11/26* (2006.01)
*A44B 11/25* (2006.01)

(52) U.S. Cl.
CPC ..... *A44B 11/266* (2013.01); *A44B 11/2519* (2013.01); *A44B 11/2561* (2013.01)

(58) Field of Classification Search
CPC A44B 11/266; A44B 11/2561; A44B 11/2519
See application file for complete search history.

(56) References Cited

U.S. PATENT DOCUMENTS 4,569,106 A * 2/1986 Lovato ..... A44B 11/266 24/587.12
4,621,393 A 11/1986 Ambal
4,779,315 A * 10/1988 Kohus ..... A44B 11/266 24/587.12
5,203,058 A * 4/1993 Krauss ..... A44B 11/266 24/587.12
5,735,024 A 4/1998 Ortiz
6,484,372 B2 * 11/2002 Novak ..... A44B 11/2592 24/312
6,571,434 B2 * 6/2003 Ortiz ..... A44B 11/006 24/265 BC
6,622,350 B2 * 9/2003 Austin ..... A44B 11/2592 24/312
7,007,353 B2 * 3/2006 Bergkvist ..... A44B 11/266 24/640
7,290,313 B2 * 11/2007 Southern ..... A44B 11/266 24/587.12
8,726,850 B2 * 5/2014 Rosenquist ..... A44B 11/263 119/863

(Continued)

FOREIGN PATENT DOCUMENTS

DE 3535419 A1 4/1986

*Primary Examiner* — Robert J Sandy
*Assistant Examiner* — Louis Mercado
(74) *Attorney, Agent, or Firm* — Nath, Goldberg & Meyer; Jerald L. Meyer

(57) ABSTRACT

A buckle arrangement has a first buckle and a second buckle connectable to the first buckle. The first buckle has a first locking device and a first locking hook, and the second buckle has a second locking device and a second locking hook. The first locking device and the second locking device are formed such that, when the first buckle is connected to the second buckle, the first locking device locks the second locking hook and the second locking device locks the first locking hook.

14 Claims, 4 Drawing Sheets

(56) References Cited

U.S. PATENT DOCUMENTS

Figure 1:
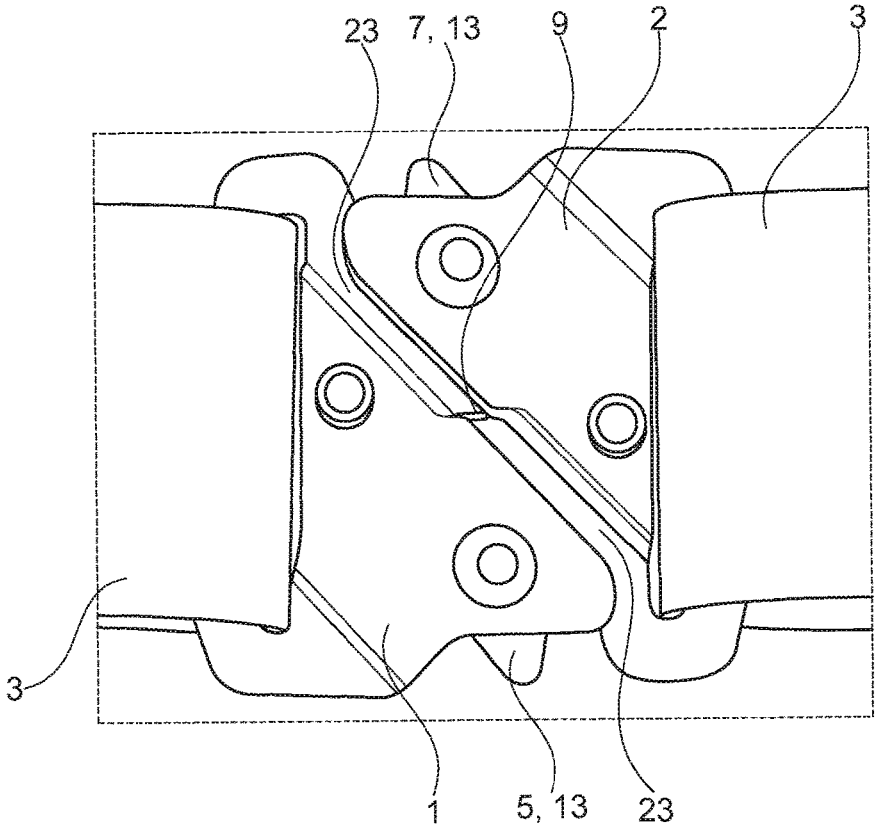

| | | | | |
|---|---|---|---|---|
| 2002/0029443 | A1* | 3/2002 | Ortiz | A44B 11/006<br>24/615 |
| 2003/0121129 | A1* | 7/2003 | Hamilton | A44B 11/266<br>24/615 |
| 2009/0119890 | A1* | 5/2009 | Laruccia | A44B 11/266<br>24/586.1 |
| 2013/0333634 | A1* | 12/2013 | Rosenquist | A44B 11/263<br>119/865 |

* cited by examiner

BUCKLE ARRANGEMENT

The invention relates to a buckle arrangement, having a first buckle and a second buckle connectable to the first buckle, wherein the first buckle has a first locking device and a first locking hook, and the second buckle has a second locking device and a second locking hook.

Buckles are known from the prior art and are used to detachably connect belts to one another or to detachably fasten a belt to another object. Buckles of this type are used primarily in the field of mountain sports, aerial sports, the military and in the field of personal protective equipment for occupational safety or the like, and are often part of climbing harnesses or similar fall arrest systems. Due to the specified fields of use, buckles must function very reliably on the one hand, since the life or at least the health of a user secured by the buckle is dependent on the fault-free functioning of the buckle, whereas on the other hand accidental incorrect operation must not be possible. In respect of these demands the embodiments known from the prior art have a locking device that often must be locked in a complex way so as to then prevent an accidental opening of the buckle in the locked state. A disadvantage of embodiments of this type is that the buckles have locking devices of very complex design, which can only be locked and unlocked likewise in a complex way.

On this basis the object of the invention is to specify a first buckle and a second buckle connectable to the first buckle that can be easily connected to and detached from one another, and/or can be produced particularly economically.

The object is achieved by the features of the independent claim. Preferred developments are specified in the dependent claims.

In this respect the object is solved by a buckle arrangement, having a first buckle and a second buckle connectable to the first buckle, wherein the first buckle has a first locking device and a first locking hook, and the second buckle has a second locking device and a second locking hook, the first locking device and the second locking device are formed such that, when connecting the first buckle to the second buckle, the first locking device locks the second locking hook and the second locking device locks the first locking hook, such that the first buckle is connected to the second buckle, and the first locking device and/or the second locking hook are formed identically and/or symmetrically, particularly point-symmetrically, to the second locking device and/or the first locking hook, at least in respect of the locking.

A key point of the invention is thus that the first buckle and the second buckle are formed identically and/or symmetrically in respect of the respective locking device and/or the respective locking hook. This means specifically that, on account of the identical or symmetrical structure of the locking device and/or the locking hook, both buckles are formed identically or symmetrically at least in part and in this respect can be manufactured much more easily. In accordance with a preferred embodiment presented further below, the first buckle and the second buckle may also be formed completely identically. A buckle arrangement then also requires only two identical buckles of a single buckle model, which significantly facilitates the manufacture. The buckle arrangement is characterised by two independent locking mechanisms, on the one hand by the first locking device having the second locking hook and on the other hand by the second locking device having the first locking hook. The second buckle connected in this way to the first buckle has a secure and very reliable connection, which meets the normative and/or legal guidelines in mountain sport, aerial sport, in the field of occupational safety and/or personal protective equipment. Lastly, in accordance with a preferred development discussed further below, the first buckle is detachable from the second buckle only when both locking devices are actuated at the same time. As a result, due to the proposed buckle arrangement, a secure and simple connection of the first buckle and second buckle is made possible, wherein the risk of an accidental detachment of the first buckle and second buckle is minimised, and in addition the buckle arrangement can be produced particularly easily and economically on account of the least partially identical or symmetrical structure of the buckles.

The first buckle and/or the second buckle preferably have a means for fastening and/or for fixing a belt, a karabiner, or the like, for example via a fixing eyelet, etc. The buckle may be part of a climbing harness or of another fall arrest system in the field of personal safety. In addition, other possible applications are also conceivable, in particular in mountain sport, in aerial sport or in the field of personal protective equipment or the military. A belt connectable to the buckle may be a known strap material, in particular a flat, flexible and/or elongate article with smaller width relative to the length. A belt of this type, also referred to as a strap, advantageously comprises polyester and/or polyamide and/or has a width of ≥30 mm and ≤45 mm. In a corresponding embodiment the first buckle and/or the second buckle may also be fastened to a cable.

Furthermore, the first buckle and/or the second buckle may have a fixed or a displaceable web (what is known as a clamping web), about which the belt and/or the cable is looped in order to produce a connection between the belt and/or the cable and the buckle. Whereas fixed webs generally are not intended for the adjustment of the belt, displaceable clamping webs are suitable for the adaptation of the belt length. The locking between locking device and locking hook and/or the connection between first buckle and second buckle is realised preferably in a form-fitting and/or frictionally engaged manner on account of a corresponding embodiment of the locking device, the locking hook and/or the buckle. Where reference is made to locking within the scope of the invention, for example in respect of identical and/or symmetrical locking of locking device to locking hook, the part of a locking device or locking hook that will be or is locked to the other locking device or locking hook is therefore meant in particular. The symmetrical or point-symmetrical embodiment can then be identified preferably in particular when the first buckle is connected to the second buckle, i.e. when the two locking devices have locked the respective locking hooks.

In accordance with a preferred development the first locking device is formed identically to the second locking device, the first locking hook is formed identically to the second locking hook, and/or the first buckle is formed identically and/or, based on the connected state, point-symmetrically to the second buckle. The two locking devices, the two locking hooks and/or the two buckles are preferably formed identically at least in respect of the locking. With regard to the point-symmetrical embodiment, the point of symmetry preferably coincides with a centrepoint of the buckle arrangement with interconnected first buckle and second buckle and/or in plan view of a buckle arrangement connected in this way. Even more preferably, the point of symmetry, in the connected state of the two buckles, is arranged on a longitudinal axis extending in the direction of connection or direction of insertion, wherein the longitudinal axis more preferably is arranged centrally along the transverse extent of the buckles. Due to identical embodiments of the locking devices, the locking hooks and/or the buckles, a particularly simple and economical production of the buckle arrangement is made possible.

In accordance with an even further preferred embodiment an unlocking of the second locking hook from the first locking device and an unlocking of the first locking hook from the second locking device is possible only by simultaneous actuation of the first locking device and the second locking device and/or is only possible when there is no tension acting on the first buckle and the second buckle. If, in accordance with the first-mentioned embodiment, the first locking device for example is accidentally actuated in order to unlock the second locking hook, the first locking hook also locked in the second locking device then prevents a detachment of the first buckle from the second buckle. In accordance with the second-mentioned embodiment an opening of the buckle arrangement is only possible when there is no longer any tension acting on the two buckles. However, if for example a force acts on two belts connected by means of the two buckles, an unlocking of the two locking devices in order to detach the respective locking hooks from the locking devices is not possible. Due to a corresponding embodiment of locking hook and locking device, for example by provision of a corresponding undercut, the unlocking can be made possible only when there is no tension acting on the two interconnected buckles. Due to the proposed embodiments, an undesired opening of the buckle arrangement can be avoided in a simple, but particularly efficient way.

In principle, the locking hooks and the locking devices may be formed arbitrarily. In accordance with a particularly preferred embodiment the first locking her and/or the second locking hook have/has a connection extension with retaining lug protruding at one end in a transverse direction, and the first locking device and/or the second locking device have/has a pawl mounted pivotably between an open position and a locking position, said pawl being formed in such a way that in the connected state the pawl, cooperating with the retaining lug, secures the connection extension in the locking position. In accordance with a preferred development the retaining lug has an undercut, the pawl engages in a form-fitting manner with the undercut in the locking position, and the retaining lug in the open position can be removed from the pawl and/or the pawl is acted on by a spring element in its locking position. The spring element is preferably formed as a metal helical spring, as an elastomer spring and/or as another spring element known from the prior art in order to apply a spring force to the pawl in such a way that the pawl is urged from its open position into the locking position.

In order to connect or latch the two buckles the connection extension of one buckle is preferably introduced into the other buckle in such a way that the retaining lug pivots the pawl from its locking position in the direction of the open position, whereby the spring element is compressed. With further compression the undercut of the retaining lug passes the pawl, whereby the pawl latches into the undercut under the influence of the spring bias of the spring element and thus ensures a form-fitting connection between the locking device and the locking hook. The connection extension is preferably formed as a web and/or the pawl is preferably formed as a pin. The pawl preferably engages with the undercut in a frictionally engaged and/or latching manner in the locking position. The buckle and parts thereof are preferably formed wholly or partially from a metal, a metal alloy or other suitable materials that enable a secure connection of the two buckles. When the pawl secures the retaining lug in the locking position, the buckles preferably cannot be separated from one another.

With reference to the previously explained developments, the first locking hook and the second locking hook each has, on the connection extension thereof on the side opposite the retaining lug, a guide surface extending in the direction of connection in such a way that when the first hook is connected to the second buckle the other connection extension can be guided by the respective guide surface. The normal of the guide surface extends preferably transversely to the direction of connection and/or in the direction of a transverse extension of the buckle perpendicularly to the direction of connection. The two guide surfaces are especially preferably pivoted slightly towards one another in respect of their surface normals in order to facilitate the connection of the buckles to one another and/or an insertion of the respective locking hook into the respective locking device. The locking hooks are preferably formed such that the two locking hooks already with connection of the buckles to one another or insertion of the respective locking hooks into the respective locking devices preferably bear against one another in a sliding manner. In the locked state one locking hook preferably bears from one side against the other locking hook and on its other side bears against the pawl with the retaining lug latched into the pawl. By providing guide surfaces of this type, the connection of the buckles can be simplified on the one hand, and on the other hand a counter bearing of one locking hook with respect to the other locking hook can be formed.

In accordance with a further particularly preferred embodiment the first buckle and/or the second buckle has a belt opening extending perpendicularly to the direction of connection for guiding through a belt, wherein the guide surfaces in the connected state are more preferably arranged centrally with respect to the extension of the belt opening. The point of symmetry in respect of the point-symmetrical embodiment is more preferably arranged on the guide surfaces or between the guide surfaces. The belt opening is preferably formed as a rectangular recess extending longitudinally on an edge of the buckle, through which recess a belt can be guided and/or fastened in order to be fastened to the buckle. The locking hook and/or the locking device is/are preferably arranged opposite the belt opening, wherein the locking hook particularly preferably extends away from the belt opening in the direction of connection in such a way that the retaining lug at the head of the connection extension is arranged on an edge of the buckle.

As already indicated, there are various possibilities for forming the first buckle and/or the second buckle. In accordance with a particularly preferred embodiment the third buckle and/or the second buckle have/has a base body, wherein the base body is formed in one part with the first locking hook and/or the second locking hook. The belt opening is more preferably introduced into the base body by a punching or a milling for example, if the base body is formed from a metal or metal sheet.

In accordance with a preferred development the base body is formed from two parts formed in mirror image to one another in such a way that, by joining together the two parts, the first locking hook and/or the second locking hook and an insertion opening are formed, into which, when the first buckle is connected to the second buckle, the second locking hook and/or the first locking hook can be inserted for locking. The two parts preferably like against one another with contact, at least in the region of the locking hooks and/or in the region of the belt opening. The two parts are more preferably each formed from a sheet metal, from a milled solid material, or the like, for example having a thickness of 3, 4 or 5 mm, wherein the insertion opening preferably can be produced by pressing and/or chamfering at least part of the sheet metal. In the region of the insertion opening the parts preferably extend in parallel and offset from the region of the locking hooks and/or the belt opening. Connection means are preferably provided in order to fix the parts joined together. The connection means may be formed as a bore, through with a screw, a rivet or the like is guided in order to fix the two parts. By means of an embodiment of this type, the buckle arrangement can be produced particularly easily, wherein each of the two buckles particularly preferably comprises the identical base body or two identical parts.

In accordance with a further preferred embodiment the first locking hook and/or the second locking hook have/has a first region and a second region adjoining the first region, and in the connected state the first region is arranged preferably completely within the insertion opening. The retaining lug is preferably arranged in the first region, and in the connected state is preferably arranged fully within the insertion opening or between the two parts. The first region and/or the second region are/is more preferably formed differently from the second region and the first region respectively, for example provided with a different colour and/or a different marking. By way of example, if the first region is coloured, it is possible to identify in a simple manner whether the two buckles are correctly interconnected: if a user, in the connected state in which the first region is arranged within the insertion opening, cannot identify the colour of the first region, then this implies in a simple visual manner that the two buckles are correctly interconnected, in particular latched to one another.

In accordance with a preferred development the pawl is mounted pivotably between the two parts and/or the pawl has a lever arm protruding from the base body in order to unlock the pawl. The pivot axis preferably extends through the two parts and extends in the direction of the surface normals of the parts. The pawl is more preferably held pivotably by means of a connection means fixing the parts joined together, in particular by means of a screw, a rivet or the like. The lever arm preferably extends from the pivot access opposite a part of the pawl locking the locking hook. In accordance with a further preferred embodiment a spacer element is arranged between the two parts and is formed in such a way that the pivoting of the pawl between open position and locking position is limited by the spacer element and/or the spacer element bears against the two parts with contact, wherein the spacer element is preferably formed from a metal and/or in one piece with the base body. The spacer element is particularly preferably formed in one piece with one of the two parts as a form-fitting shaping of the part. Alternatively, the spacer element may be formed from a plastic and fixed to the two parts by means of a connection means. The spacer element on the one hand more preferably delimits the insertion opening and/or on the other hand the belt opening. In accordance with an even more preferred embodiment the spring element is held at one end by the spacer element, in particular guided in a blind hole in the spacer element.

In accordance with an even more preferred embodiment the first locking device and the second locking device are formed such that, by connecting the first buckle to the second buckle, the first locking device locks the second locking hook in a latching manner and the second locking device locks the first locking hook in a latching manner, in particular simultaneously. In accordance with an even further preferred embodiment a third buckle is provided, wherein the third buckle has a third locking device and a third locking hook, and the three buckles are formed such that, by connecting two of the three buckles to one another, the respective locking device of one buckle locks the respective locking hook of the other buckle. In accordance with this embodiment various configurations are conceivable, for example a first buckle and a second buckle having a respective feedthrough opening for a belt, whereas the third buckle has an eyelet for a karabiner. On account of the identical or symmetrical embodiment of the locking however, the three buckles can be interconnected in advantageously any way.

The invention will be explained in greater detail hereinafter with reference to the accompanying drawings on the basis of a preferred embodiment.

In the drawings

Figure 2:
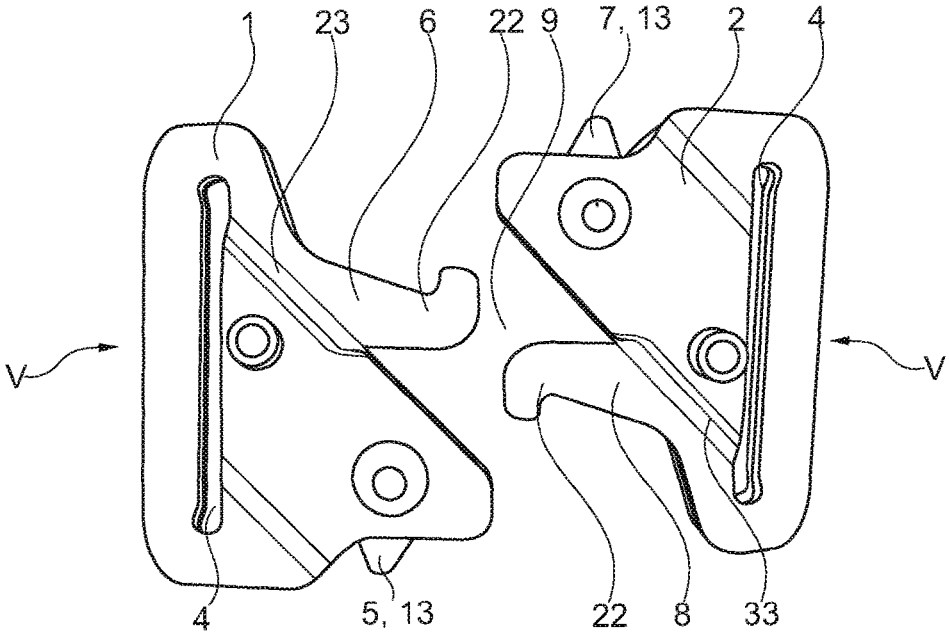
Figure 3:
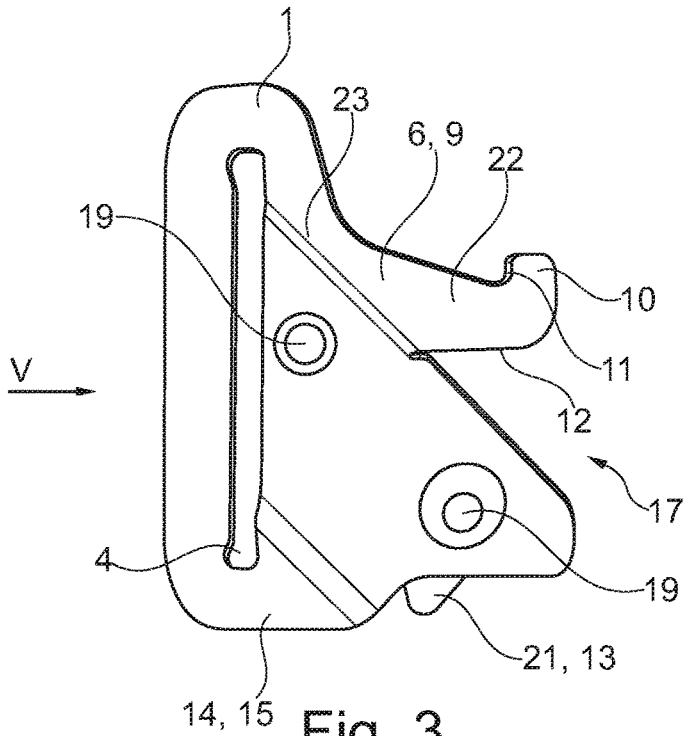
Figure 4:
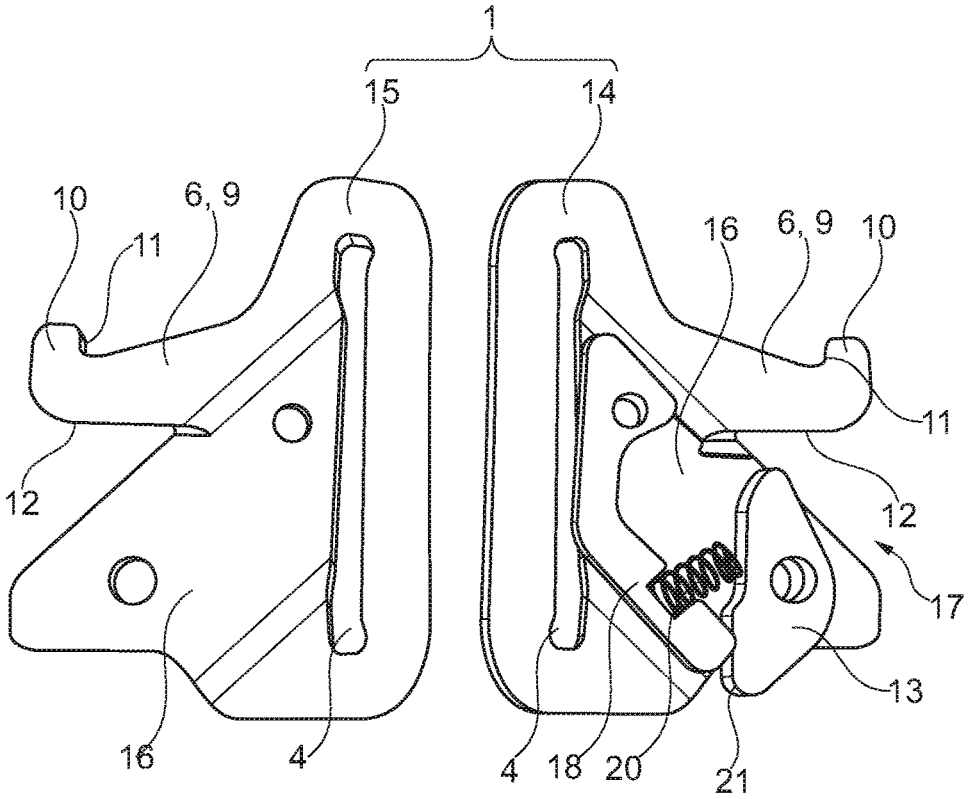
Figure 5:
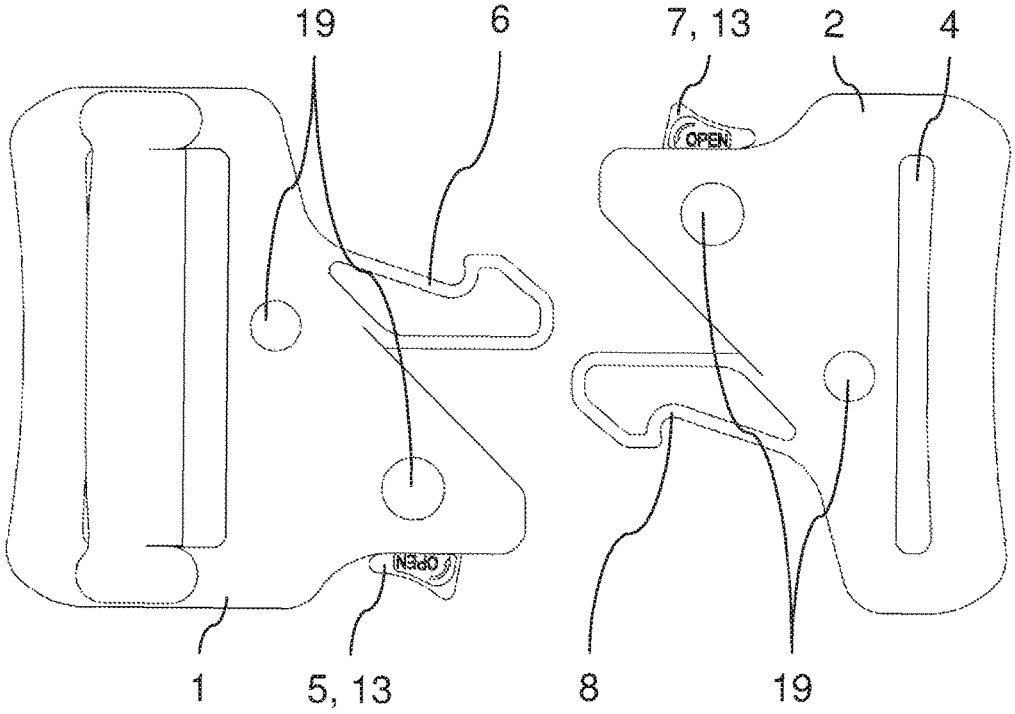
Figure 6:
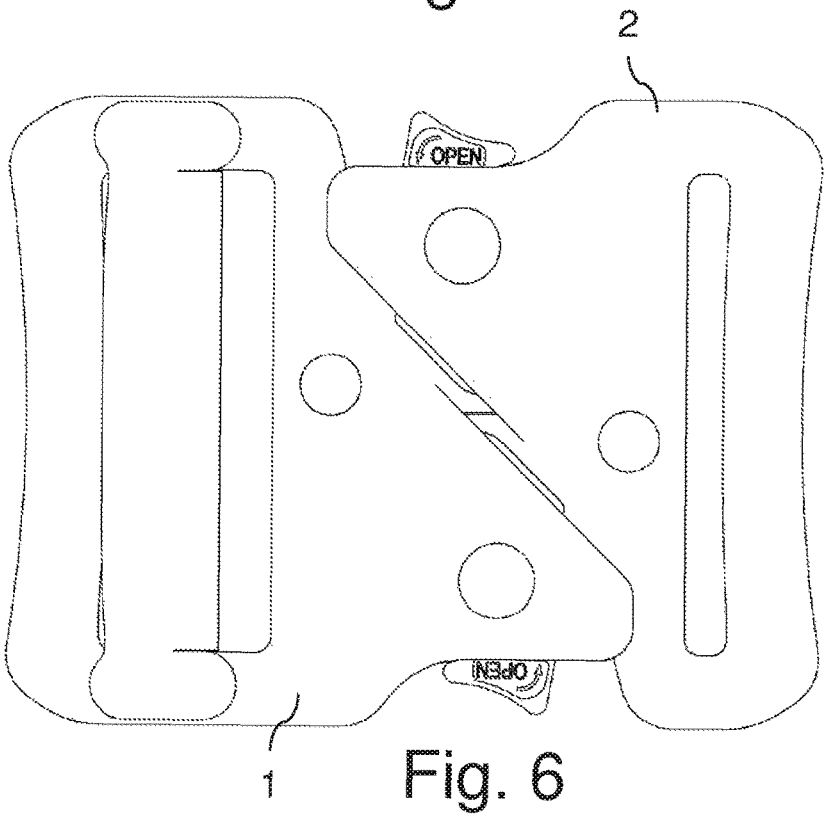
Figure 7:
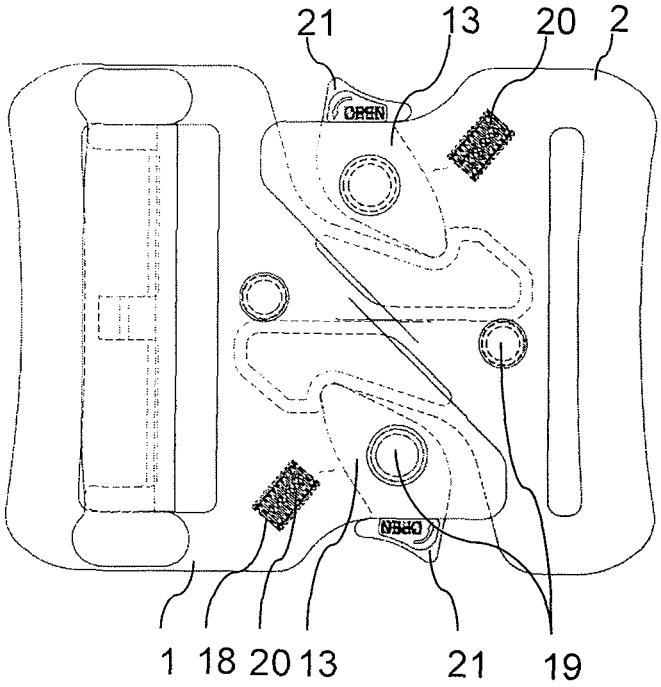
Figure 8:
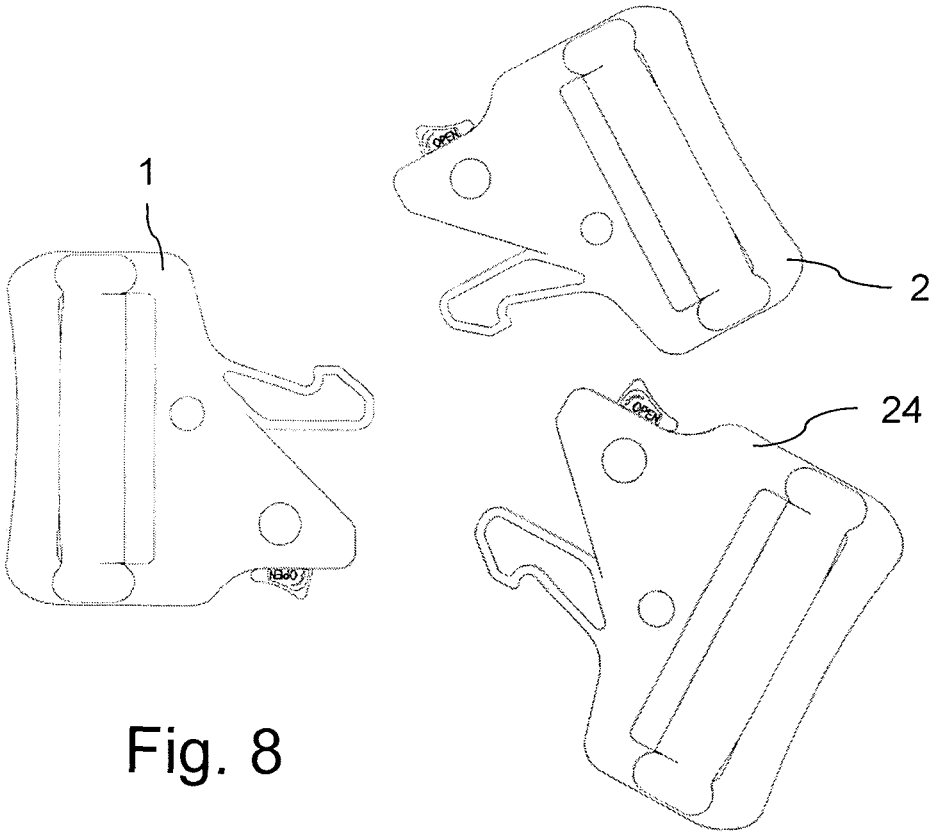

FIG. 1 shows a buckle arrangement in a connected state in accordance with a preferred exemplary embodiment of the invention in a plan view, FIG. 2 shows the buckle arrangement according to FIG. 1 in an unconnected state in a plan view, FIG. 3 shows a buckle of the buckle arrangement shown in FIG. 1 or 2 in a plan view, FIG. 4 the buckle according to FIG. 3 in a disassembled state in a plan view, FIG. 5 shows a buckle arrangement in an unconnected state in accordance with a further preferred exemplary embodiment of the invention in a plan view, FIG. 6 shows the buckle arrangement according to FIG. 5 in a connected state in a plan view, FIG. 7 shows the buckle arrangement according to FIG. 6 in a partially transparent plan view, and FIG. 8 shows a buckle arrangement in accordance with a further preferred exemplary embodiment of the invention comprising three buckles.

FIG. 1 shows a buckle arrangement in accordance with a preferred exemplary embodiment of the invention in a plan view, having a first buckle 1 and a second buckle 2 connected to the first buckle 1. In this way, the two buckles 1 and 2 connect a belt 3 of a climbing harness (not shown), said belt being connected to the respective buckles 1, 2. The belt 3 is made of textile, wherein polyamide or the like is also possible, and has a width of 45 mm. As can be better seen from FIG. 2, each of the two buckles 1, 2 has a rectangular belt opening 4, through which the belt 3 in the illustration shown in FIG. 1 is guided for the fastening of a respective buckle 1, 2. The belt opening 4 extends lengthwise perpendicularly to the direction of connection v of the buckles 1, 2.

The two buckles 1, 2 are formed identically in the present case, which means that, together with a third buckle (not shown), any two of the three buckles 1, 2 can be interconnected. Specifically, the first buckle 1 has a first locking device 5 and a first locking hook 6. The second buckle 2 has a second locking device 7 and a second locking hook 8. In accordance with the above, the first locking device 5 and the second locking device 7 are formed identically, and the first locking hook 6 and the second locking hook 8 are formed identically.

In other words, as can be seen from FIGS. 1 and 2, the two buckles 1, 2, based on the connected state shown in FIG. 1, are formed point-symmetrically or mirror-symmetrically with respect to a point of symmetry 9. Accordingly, the locking devices 5, 7 and the locking hooks 6, 8 are also arranged mirror-symmetrically with respect to the point of symmetry 9, which is also shown in FIG. 2 showing a non-connected state of the buckles 1, 2.

When connecting the first buckle 1 to the second buckle 2, the first locking device 5 locks the second locking hook 8 and the second locking device 7 locks the first locking hook 6. On account of the identical embodiment of first buckle 1 and second buckle 2, an unlocking can be performed only by simultaneous actuation of the two locking devices 5, 7. In addition, as is clear from the following detailed description of the locking hooks 6, 8 and the locking devices 5, 7, an unlocking is possible only when there is no tension acting on the two buckles 1, 2 or the belts 3 connected to the two buckles 1, 2 shown in FIG. 1.

For further description of the buckles 1, 2, reference is made to the first buckle 1 shown in FIGS. 3 and 4. Since the two buckles 1, 2 are formed identically, the comments made hereinafter with reference to FIGS. 3 and 4 also apply to the second buckle 2 and the second locking hook 8 as well as the locking device 7.

As can be seen from FIG. 3, the first locking hook 6 has a connection extension 9. Whereas the belt opening 4 is arranged on one side the first buckle 1, the connection extension 9 or the first locking hook 6 extends on the other, opposite side in the direction of connection v away from the belt opening 4 in a direction substantially perpendicularly to the longitudinal extension of the belt opening 4. A retaining lug 10 protruding in the transverse direction at one end is arranged at the tip of the connection extension 9 and forms an undercut 11.

On the side opposite the retaining lug 10 a guide surface 12 extending substantially in the direction of connection v is formed, of which the surface normal extends substantially in the direction of the longitudinal extension of the belt opening 4. The first locking device 5 has a pawl 13 mounted pivotably between an open position and a closed position. The pivot axis of the pawl 13 extends out from the drawing plane in the direction of the surface normals of the surface of the first buckle 1.

The first buckle 1 has a base body, which is formed from two parts 14, 15 formed symmetrically to one another. In the mounted state shown in FIG. 3 of the first buckle 1 the two parts 14, 15 lie congruently one above the other and bear against one another with contact in the region of the locking hook 6 and in the region of the belt opening and thus form the first locking hook 6 and the belt opening 4. In FIG. 4 the upper part 15 of the base body is detached from the lower part 14 of the base body and pivoted against the direction of connection v about an axis extending in the longitudinal extent of the belt opening 4. It can be seen in this way that the two parts 14, 15 are each arranged in an offset manner by means of a pressing process and have a region 16 extending in parallel, which in the assembled state of the two parts 14, 15 as shown in FIG. 3 forms an insertion opening for the insertion of the second locking hook into the first buckle 1.

In the insertion opening 17 formed in this way there is arranged, between the two parts 14, 15, the first locking device 5 in the form of the pawl 13. A spacer element 18 made of a plastic is also provided and in the assembled state of the two parts 14, 15 shown in FIG. 3 bears against the upper part 15 and also against the lower part 14. In an alternative embodiment the spacer element 18 is formed as a form-fitting shaping of one of the two parts 14, 15 and is thus formed in one piece with the part 14, 15 in question. In the mounted state of the two parts 14, 15 shown in FIG. 3, the parts 14, 15 are interconnected by two connection means 19, wherein one connection means 19 is guided through the two parts 14 and also the spacer element 18, and the other connection means 19 is guided through the two parts 14, 15 and also the pawl 13 in order to fix the pawl and form the pivot axis.

In the present case the connection means 19 are formed as screws with nuts, wherein it is also possible however to use rivets or the like. A blind-hole-like bore is provided in the spacer element 18, in which bore a spring element 20 is held at one end. With form-fitting shaping of the spacer element 18 with one of the two parts 14, 15, the spring element 20 is preferably held by the part 14, 15, for example in a receiving opening formed by both parts 14, 15. The spring element 20 is formed in the present case as a helical spring and acts on the pawl 13 in such a way that the pawl 13 is urged into its locking position. A lever arm 21 of the pawl 13 protrudes from the base body or the two parts 14, 15, by means of which pivot arm the pawl 13 can be pivoted by actuation by an operator into its open position (not shown).

If the two buckles 1, 2 are now moved from the position shown in FIG. 2 in the respective direction of connection v for connection of the buckles 1, 2 to one another, or if only a single one of the two buckles 1, 2 is moved in the direction of connection v, the two locking hooks 6, 8 initially slide via their retaining lugs 10 firstly into the respective insertion opening 17 of the respective other buckle 1, 2, guided by their respective guide surfaces 12. The retaining lugs 10 pivot the pawls 3, whereby the spring elements 20 are compressed. With further compression the respective undercuts 11 pass the respective pawls 13, which under the influence of the spring bias of the respective spring elements 20 latch into the respective undercuts 11 and in this way produce a form-fitting connection between the locking devices 5, 7 and the respective locking hooks 6, 8.

In order to visually identify that the latching or locking has been performed, the two locking hooks 6, 8 each have a first region 22 and an adjoining second region 23. The first region 22 is coloured differently from the second region. In the non-connected state of the buckles 1, 2 shown in FIG. 2, both the first region 22 and the second region 23 can be seen. In the connected state shown in FIG. 1, only the second region 23 can still be seen, whereas the first region 22 with the different colouring is arranged completely within the respective insertion opening 17 or the respective other buckle 1, 2. The majority of the connection extension 9 and the retaining lugs 10 are part of the first region 22.

If the buckles 1, 2 shown connected to one another in FIG. 1 now act on the belts 3 with tension, the locking hooks 6, 8 are latched to one another and the locking devices 7, 9 then prevent a detachment of the buckles 1, 2 from one another. Even with accidental actuation of a single locking device 5, 7, i.e. by actuation of the lever arm 21, the buckles 1, 2 still do not detach from one another, since the respective other locking device 5, 7 continues to secure the buckles 1, 2 against unlocking. Only with simultaneous actuation of the lever arms 21 of the two locking devices 5, 7 are the locking hooks 6, 8 unlocked or unlatched.

FIGS. 5 to 7 show a buckle arrangement in accordance with a further preferred exemplary embodiment of the invention. In this embodiment the first buckle 1 and the second buckle 2 each also have a base body, which is formed from two parts 14, 15 formed symmetrically to one another. Compared with the embodiment shown in FIGS. 1 to 4 however, no separate spacer element 18 is provided, as shown in FIG. 4. Instead, the spacer element 18 is formed or moulded as a form-fitting shaping of one of the two parts 14, 15 and is thus formed or moulded in one piece with the relevant part 14, 15. Accordingly, the spring element 20 is held in a receiving opening formed in the base body or is supported on the base body, as is indicated by reference sign 18.

FIG. 8 shows a buckle arrangement in accordance with a further preferred exemplary embodiment of the invention comprising the first buckle 1, the second buckle 2 and a third buckle 24, wherein the third buckle 24 has a third locking device and a third locking hook, and the three buckles 1, 2, 24 are formed such that, by connecting two of the three buckles 1, 2, 24 to one another, the respective locking device of one buckle 1, 2, 24 locks the respective locking hook of the other buckle 1, 2, 24.

LIST OF REFERENCE SIGNS first buckle 1
second buckle 2
belt 3
belt opening 4
first locking device 5
first locking hook 6
second locking device 7
second locking hook 8
point of symmetry 9
retaining lug 10
undercut 11
guide face 12
pawl 13
part 14, 15
offset part 16
insertion opening 17
spacer element 18
connection means 19
spring element 20
lever arm 21
first region 22
second region 23
third buckle 24
direction of connection v

The invention claimed is:

1. A buckle arrangement, having a first buckle and a second buckle connectable to the first buckle, wherein the first buckle has a first locking device and a first locking hook, and the second buckle has a second locking device and a second locking hook, the first locking device and the second locking device are formed such that, when connecting the first buckle to the second buckle, the first locking device locks the second locking hook and the second locking device locks the first locking hook, such that the first buckle is connected to the second buckle, the first locking device and the second locking hook are formed symmetrically, particularly point-symmetrically, to the second locking device and the first locking hook, at least in respect of a locking, the first locking hook and the second locking hook in a direction of connection each have a connection extension with a retaining lug protruding at one end in a transverse direction, the first locking device and the second locking device each have a pawl which is mounted pivotably between an open position and a locking position and formed in such a way that each pawl in a connected state, cooperating with the respective retaining lug, secures the respective connection extension in the locking position, the first buckle and the second buckle each have a base body, and each base body is formed in one part with the respective locking hook, the base body is formed from two parts that are in mirror image to each other such that when the two parts are joined, the respective locking hook and an insertion opening of each buckle are formed, and the respective locking hook can be inserted for locking when the first buckle is connected to the second buckle, the first buckle and the second buckle each have a belt opening for guiding through a belt, and the two parts lie against one another with contact at least in a region of the locking hooks and the belt opening.

2. The buckle arrangement according to claim 1, wherein the first locking device is formed identically to the second locking device, the first locking hook is formed identically to the second locking hook, and the first buckle is formed identically and point-symmetrically to the second buckle, based on the connected state.

3. The buckle arrangement according to claim 1, wherein an unlocking of the second locking hook from the first locking device and an unlocking of the first locking hook from the second locking device is possible only by simultaneous actuation of the first locking device and the second locking device and/or is possible only when there is no tension acting on the first buckle and the second buckle.

4. The buckle arrangement according to claim 3, wherein each retaining lug has an undercut, the respective pawl engages in a form-fitting manner with the undercut in the locking position, and the retaining lug in the open position can be removed from the pawl and the pawl is acted on by a spring element in its locking position.

5. The buckle arrangement according to claim 4, wherein the spring element is held at one end by the spacer element, in particular is held in a blind hole in the spacer element.

6. The buckle arrangement according to claim 3, wherein the first locking hook and the second locking hook each have, on the connection extension thereof on a side opposite the retaining lug, a guide surface extending in the direction of connection in such a way that when the first buckle is connected to the second buckle another connection extension can be guided by a respective guide surface.

7. The buckle arrangement according to claim 6, wherein each belt opening has a perpendicular extension to the direction of connection, and the guide surfaces in the connected state are arranged centrally with respect to the perpendicular extension of the belt opening.

8. The buckle arrangement according to claim 1, wherein the first locking hook and the second locking hook each have a first region and a second region adjoining the first region, and in the connected state the first region is arranged completely within the insertion opening.

9. The buckle arrangement according to claim 8, having a spacer element arranged between the two parts of each buckle and formed in such a way that pivoting of the pawl between the open position and the locking position is limited by the spacer element and/or the spacer element bears against the two parts of each buckle with contact, wherein the spacer element is formed from a metal and/or in one piece with the base body.

10. The buckle arrangement according to claim 1, wherein each pawl is mounted pivotably between the two parts of each buckle and/or the pawl has a lever arm protruding from the respective base body in order to unlock the pawl.

11. The buckle arrangement according to claim 1, wherein the first locking device and the second locking device are formed such that, by connecting the first buckle to the second buckle, the first locking device locks the second locking hook in a latching manner and the second locking device locks the first locking hook in a latching manner.

12. The buckle arrangement according to claim 1, having a third buckle identical to the first and second buckles, wherein the third buckle has a third locking device and a third locking hook, and the three buckles are formed such that, by connecting two of the three buckles to one another, respective locking device of one buckle locks respective locking hook of another buckle.

13. The buckle arrangement according to claim 1, wherein the two parts of each buckle are each arranged in an off-set manner and have a region extending in parallel, which in an assembled state of the two parts of each buckle forms an insertion opening for insertion one of the locking hook into the buckle.

14. The buckle arrangement according to claim 13, wherein the insertion opening of each buckle is produced by pressing and/or chamfering.

* * * * *